US008573186B2

(12) United States Patent
Rettich et al.

(10) Patent No.: US 8,573,186 B2
(45) Date of Patent: Nov. 5, 2013

(54) INJECTOR FOR INJECTING FUEL INTO COMBUSTION CHAMBERS OF INTERNAL COMBUSTION ENGINES

(75) Inventors: Andreas Rettich, Herrenberg-Kuppingen (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1231 days.

(21) Appl. No.: 12/446,069

(22) PCT Filed: Sep. 12, 2007

(86) PCT No.: PCT/EP2007/059593

§ 371 (c)(1), (2), (4) Date: Apr. 17, 2009

(87) PCT Pub. No.: WO2008/049691

PCT Pub. Date: May 2, 2008

(65) Prior Publication Data

US 2010/0294240 A1 Nov. 25, 2010

(30) Foreign Application Priority Data

Oct. 23, 2006 (DE) ..... 10 2006 049 885

(51) Int. Cl.
*F02M 59/46* (2006.01)
*F02M 57/02* (2006.01)
*F02M 41/16* (2006.01)

(52) U.S. Cl.
USPC ..... 123/467; 123/446; 239/96

(58) Field of Classification Search
USPC ..... 123/456, 445, 446, 447, 467, 470; 239/96, 585.1
See application file for complete search history.

(56) References Cited

U.S. PATENT DOCUMENTS

| | | | | |
|---|---|---|---|---|
| 5,727,525 | A * | 3/1998 | Tsuzuki | 123/447 |
| 5,947,380 | A * | 9/1999 | Coldren et al. | 239/88 |
| 6,109,542 | A * | 8/2000 | Morris et al. | 239/88 |
| 6,168,132 | B1 * | 1/2001 | Frank et al. | 251/33 |
| 6,257,499 | B1 * | 7/2001 | Sturman | 239/96 |
| 8,186,609 | B2 * | 5/2012 | Rapp et al. | 239/533.3 |
| 2002/0014540 | A1 * | 2/2002 | Cooke | 239/102.1 |
| 2006/0000451 | A1 * | 1/2006 | Ricco et al. | 123/447 |
| 2006/0000453 | A1 * | 1/2006 | Ricco et al. | 123/467 |
| 2006/0011736 | A1 * | 1/2006 | Ricco et al. | 239/96 |
| 2006/0027684 | A1 | 2/2006 | Ricco et al. | |
| 2006/0032950 | A1 * | 2/2006 | Ricco et al. | 239/585.1 |
| 2007/0102536 | A1 * | 5/2007 | Lehtonen | 239/88 |
| 2007/0205302 | A1 | 9/2007 | Ricco et al. | |
| 2008/0029067 | A1 * | 2/2008 | Boecking | 123/456 |

FOREIGN PATENT DOCUMENTS

| | | | |
|---|---|---|---|
| DE | 102004041172 | B3 | 1/2006 |
| DE | 102005040912 | A1 | 3/2007 |
| EP | 1612403 | A1 | 1/2006 |
| EP | 1612405 | A1 | 1/2006 |
| EP | 1621764 | A1 | 2/2006 |

* cited by examiner

*Primary Examiner* — Stephen K Cronin
*Assistant Examiner* — Sizo Vilakazi
(74) *Attorney, Agent, or Firm* — Michael Best & Friedrich LLP

(57) ABSTRACT

The invention relates to an injector for injecting fuel into combustion chambers of internal combustion engines. According to the invention, a valve seat of a control valve is designed as a flat seat that has a planar valve seat surface. A circumferential edge located on the face of a sleeve of the control valve rests on the planar valve seat surface when the control valve is closed.

19 Claims, 2 Drawing Sheets

INJECTOR FOR INJECTING FUEL INTO COMBUSTION CHAMBERS OF INTERNAL COMBUSTION ENGINES

CROSS-REFERENCE TO RELATED APPLICATION

This application is a 35 USC 371 application of PCT/EP 2007/059593 filed on Sep. 12, 2007.

BACKGROUND OF THE INVENTION

1. Field of the Invention

The invention relates to an injector for injecting fuel into combustion chambers.

2. Description Of The Prior Art

European Patent Disclosure EP 1 612 403 A1 describes a common rail injector with a control valve, in pressure equilibrium in the axial direction, for blocking and opening a fuel outflow course from a control chamber. By means of the control valve, the fuel pressure inside the control chamber can be varied. The control chamber is supplied via a pressure conduit with fuel from a pressure chamber communicating hydraulically with a high-pressure fuel reservoir. Varying the fuel pressure inside the control chamber adjusts a nozzle needle between an opening position and a closing position; in its opening position, the nozzle needle enables the flow of fuel into the combustion chamber of an internal combustion engine. The control valve has a valve sleeve, which is adjustable in the axial direction by means of an electromagnetic drive and which cooperates with a stationary, conical valve seat face in a sealing fashion. In long-term use of the known injector, wear can be observed in the region of the valve seat. Because of the seat wear, a circular-annular surface develops on both the valve seat and the valve sleeve, and as a consequence the control valve is no longer in pressure equilibrium, and the opening characteristic of the control valve is subject to major changes over the service life of the injector. The opening behavior of the control valve is highly pressure-dependent over the course of time, which leads to marked changes in the injection quantities.

OBJECT AND SUMMARY OF THE INVENTION

It is therefore the object of the invention to propose an injector having a control valve whose opening characteristic remains at least substantially constant over its service life.

The invention is based on the concept of providing, instead of a raised and for instance conical valve seat, a valve seat embodied as a flat seat that has a planar valve seat face; the planar valve seat face cooperates in sealing fashion with a face-end encompassing edge of the valve sleeve of the control valve. The encompassing edge extends axially from the valve sleeve. With the control valve closed, the valve sleeve is pressed with its face-end encompassing edge against the planar valve seat face. Because of the combination of a planar valve seat face and the radially narrow contact area (encompassing edge) of the valve sleeve, it is assured that despite unavoidable wear, no pressure engagement face for the fuel pressure in the axial direction is created on the valve sleeve; thus the opening characteristic is essentially preserved over the service life of the control valve. To obtain a control valve that is in pressure equilibrium in the axial direction, the encompassing edge or in other words the contact edge with which the valve sleeve rests on the planar valve seat face must be formed by the inner circumference of the valve sleeve. In other words, the diameter of the encompassing edge, in the case of a control valve that is axially in pressure equilibrium, is equal to the inside diameter of the valve sleeve in its guidance portion on the guide bolt that absorbs the axial pressure forces.

The effects of wear on the opening characteristic of the control valve are minimal if an annular face, extending radially outward from the encompassing edge, forms an angle with the valve seat face.

This angle must be dimensioned such that first, the wear of the valve sleeve and of the valve seat is minimal, and second, flow forces on the valve sleeve, which are caused by fuel that flows into a low-pressure chamber surrounding the valve sleeve when the control valve is open, are minimized. It has been found that depending on the injection pressures for which the injector is designed, angles in a range between approximately 0.5° and 20° between the valve seat face and the annular face are suitable. Preferably, the angle is between approximately 1° and 10°; optimal results are attained at an angle of approximately 5°.

For implementing a safety concept, in a refinement of the invention, for the sake of the axial pressure equilibrium a defined pressure engagement face can be provided, which assures that if a maximum fuel pressure inside the valve sleeve is exceeded, the valve sleeve lifts from the planar valve seat and the fuel that is at an impermissible overpressure can thus flow out into a low-pressure chamber. In particular, the pressure engagement face is dimensioned such that at fuel pressures above 2100 bar, and in particular above 2200 bar, the valve sleeve lifts from the valve seat counter to the force of a valve spring.

In a refinement of the invention, it is advantageously provided that the pressure engagement face is embodied as an encompassing pressure step. This kind of pressure engagement face is easy to produce with high precision.

Preferably, the encompassing edge with which the valve sleeve rests on the planar valve seat face is disposed with radial spacing from the inner surface, guided on the guide bolt, of the valve sleeve. The pressure engagement face, preferably embodied as an encompassing pressure step, is located in a region between this inner surface and the encompassing edge.

Angular errors between the valve sleeve and the planar valve seat are minimized if the guide bolt is embodied integrally with a component that forms or has the valve seat. The guide bolt extends in the axial direction into the valve sleeve from a region radially inside the planar valve seat face.

Angular errors between the valve sleeve and the valve seat face can be further reduced by providing that the valve sleeve, in a feature of the invention, is embodied integrally with an armature plate of the actuator embodied as an electromagnetic drive.

Advantageously, the fuel outflow course extends through the component having the valve seat axially into the guide bolt and from there radially out of the guide bolt into an annular chamber inside the valve sleeve. From there, when the valve sleeve is lifted from the valve seat, the fuel can flow radially into a low-pressure chamber.

BRIEF DESCRIPTION OF THE DRAWINGS

Further advantages, characteristics and details of the invention will become apparent from the ensuing description of preferred exemplary embodiments and from the drawings, in which.

DESCRIPTION OF THE PREFERRED EMBODIMENTS

Figure 1:
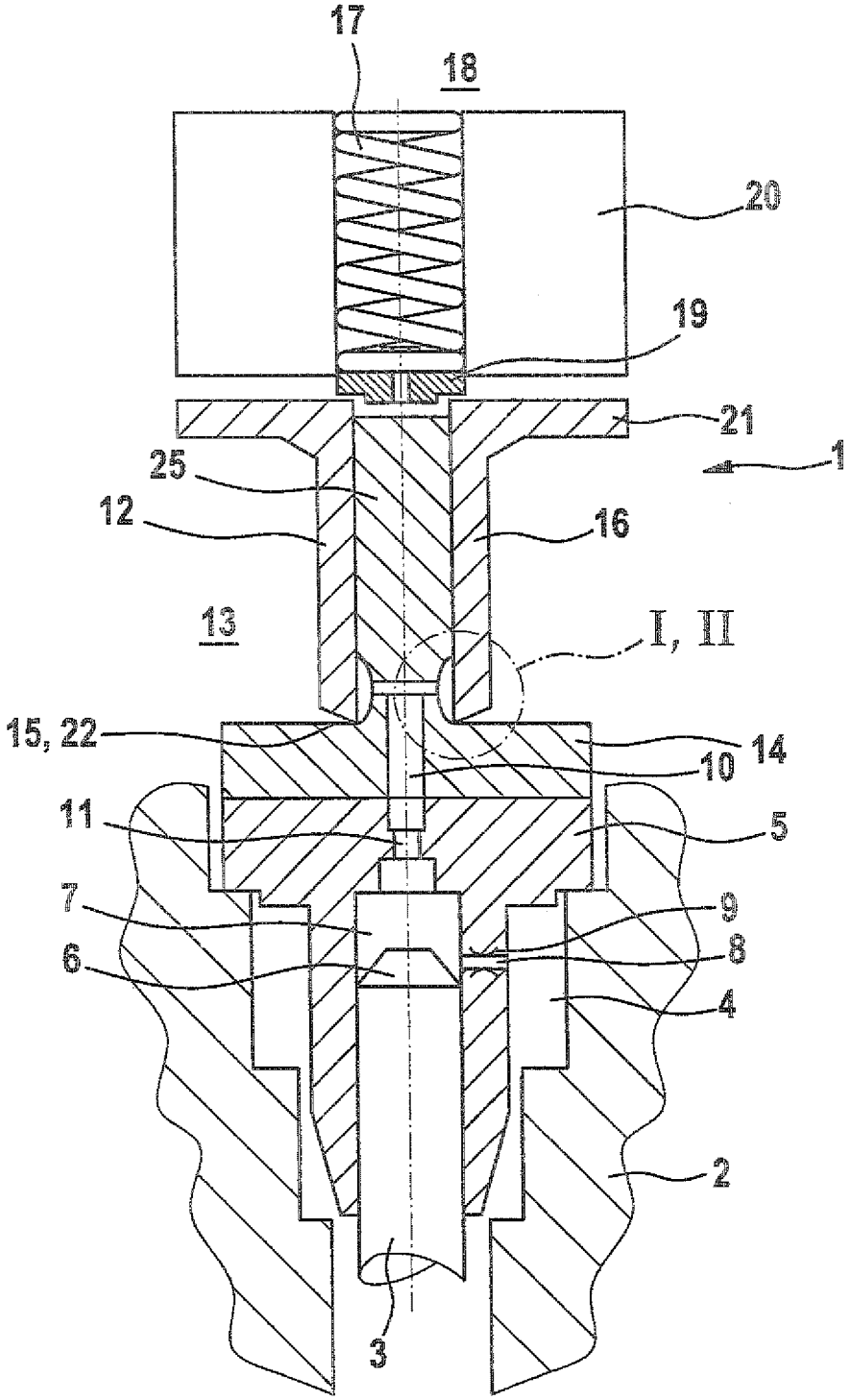
FIG. 1 shows a schematic sectional view of an injector.

In the drawings, identical components and components with the same functions are identified by the same reference numerals.

In FIG. 1, the parts of a common rail injector 1 that are essential to control are shown schematically. Inside a nozzle body 2, an elongated nozzle needle 3 is guided movably in the axial direction. The nozzle needle 3, on its needle tip, not shown, has a closing face with which it can be brought into tight contact with a needle seat, also not shown, inside the nozzle body a 2. When the nozzle needle 3 is seated on the needle seat, the emergence of fuel from a nozzle hole array, not shown, is blocked. Conversely, if it is lifted from the needle seat, then fuel can flow out of a pressure chamber 4 in the axial direction along the nozzle needle 3 through the nozzle hole array and there, essentially at the high pressure (rail pressure), can be injected into a combustion chamber. The fundamental construction of an injector 1 is known. In this respect, see German Patent Disclosure DE 100 24 703 A1.

The injector 1 has a throttle plate 5, which extends in sleevelike fashion downward in the plane of the drawing into the nozzle body 2. A control chamber 7 is defined by the sleevelike portion of the throttle plate 5 and the face end 6 of the nozzle needle 3. The control chamber 7 communicates with the pressure chamber 4 via a pressure conduit 8 having an inlet throttle restriction 9, and the pressure chamber in turn communicates with a high-pressure fuel reservoir, via a supply line, not shown. Via the pressure conduit 8, fuel at high pressure can thus flow into the control chamber 7. From the control chamber 7, a fuel outflow path 10 with an outflow throttle restriction 11 leads in the axial direction. Via the fuel outflow path 10, when a control valve 12 is open, fuel can flow out of the control chamber 7 into a low-pressure chamber 13. The flow cross sections of the inflow throttle restriction 9 and outflow throttle restriction 11 are adapted to one another such that the inflow through the pressure conduit 8 is less than the outflow through the fuel outflow path 10, and accordingly, when the control valve 12 is open, there is a net outflow of fuel from the control chamber 7. The resultant pressure drop in the control chamber 7 causes the closing force to drop below the opening force and causes the nozzle needle 3 to lift from its needle seat.

The fuel outflow path 10 leads through the throttle plate 5 with the outflow throttle restriction 11 into a component 14 disposed above it in the plane of the drawing. The component 14 has a valve seat 22 (fiat seat) with a planar valve seat face 15 of the control valve 12, and when the control valve is closed, a valve sleeve 16 of the control valve 12 rests sealingly on the valve seat face 15. For that purpose, the valve sleeve 16 is urged by spring force by a valve spring 17 onto the valve seat face 15 in the axial direction. The valve spring 17 is braced at the top in terms of the plane of the drawing on an injector body 18 and on the opposite end on a spring guide part 19, which in turn rests on the valve sleeve 16. The valve sleeve 16 is penetrated in the axial direction by a guide bolt 25, on the outer face of which it is guided. The guide bolt 25 is embodied integrally with a cylindrical portion of the component 14.

The valve spring 17 is disposed inside an electromagnet 20. When current is supplied to the electromagnet 20, an armature plate 21, embodied integrally with the valve sleeve 16, is moved axially in the direction of the electromagnet 20, as a result of which the valve sleeve 16 lifts from the valve seat face 15 counter to the spring force of the valve spring 17, which in turn enables the flow of fuel out of the control chamber 7 via the fuel outflow path 10 into the low-pressure chamber 13. From there, the fuel can flow out to a tank via a return line, not shown. The pressure inside the low-pressure chamber 13, depending on the operating state, amounts to between approximately 0 and 10 bar, while conversely the fuel pressure inside the pressure chamber 4 is between approximately 1800 and 2000 bar.

Figure 2:
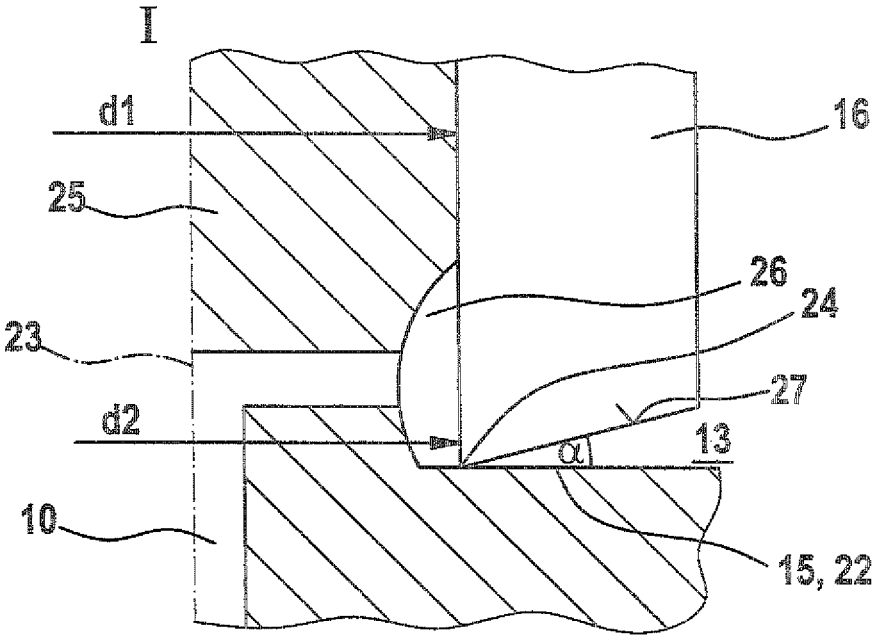
FIG. 2 shows one possible embodiment of a detail of FIG. 1.

As can be seen from FIG. 2, the valve seat face 15 of the valve seat 22 is planar, and the valve seat face 15 extends transversely to the longitudinal center axis 23 of the valve sleeve 16. With an axially extending, face-end encompassing edge 24, the valve sleeve 16 rests on the valve seat face 15 when the control valve 12 is closed. The encompassing edge 24 is embodied on the inside diameter d1 of the valve sleeve 16. In other words, the diameter d2 of the valve sleeve 16 at the encompassing edge 24 is equivalent to the diameter d1 of the valve sleeve 16 in the guidance portion on the guide bolt 25. Because the diameter d2 is equivalent to the diameter d1, the control valve 12 in FIG. 2 is in pressure equilibrium in the axial direction. This means that no pressure forces, or only minimal pressure forces, act on the valve sleeve 16 in the axial direction.

The encompassing edge 24 is adjoined in the radial direction outward by a conical annular face 27. In the exemplary embodiment shown, this annular face forms an angle $\alpha$ of approximately 5° with the planar valve seat face 15.

It can also be seen from FIG. 2 that the fuel outflow course changes over from an axial portion to a radial portion and discharges into an annular chamber 26 defined on one side by the guide bolt 25 and on the other by the valve sleeve 16.

Figure 3:
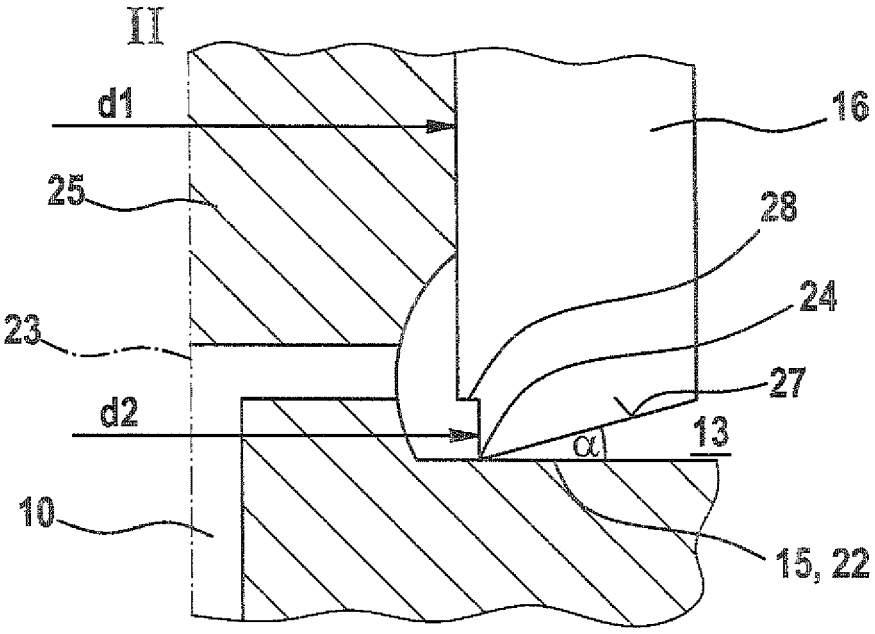
FIG. 3 shows an alternative embodiment of the detail of FIG. 1.

The injector 1 in FIG. 1 may also be embodied as shown in FIG. 3. In this variant embodiment as well, a planar valve seat face 15 is provided. In a distinction from the exemplary embodiment in FIG. 2, the diameter d2 of the valve sleeve 16 in the region of the encompassing edge 24 is not equivalent to the diameter d1 of the valve sleeve 16 in the guidance region immediately radially outside the guide bolt 25. The diameter d2 is slightly greater than the diameter d1, as a result of which, an annular pressure engagement face 28 embodied as a pressure step is formed on the valve sleeve 16. This pressure engagement face 28 prevents damage to or destruction of the injector if a maximum allowable fuel pressure inside the control valve 12 is exceeded. The pressure engagement face 28 is dimensioned such that if an impermissible pressure level, for instance of approximately 2200 bar, is reached, the valve sleeve 16 lifts from the valve seat 22, and fuel can thus flow out into the low-pressure chamber 13.

In the same way as in the exemplary embodiment of FIG. 2, in the exemplary embodiment of FIG. 3 as well a radially outer conical face 27 adjoins the encompassing edge 24, which with the planar valve seat face 15, or its imaginary extension, forms an angle $\alpha$ of approximately 5°.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into combustion chambers of internal combustion engines, in particular a common rail injector, having a valve sleeve of a control valve, which valve sleeve surrounds a guide bolt and is disposed axially movably relative to a valve seat, and a fuel outflow path from a control chamber, which path communicates hydraulically with a pressure conduit serving to deliver fuel, which path can be both closed and opened by means of the control valve, as a result of which pressure in the control chamber is controllable, so that a nozzle needle communicating operatively with the control chamber is adjustable between an opened position that enables fuel flow and a closed position, wherein the valve seat is embodied as a flat seat with a planar valve seat face; and that the valve sleeve, when the control valve is closed, rests with a face-end encompassing edge on the planar valve seat face, and the guide bolt is embodied integrally with a component disposed with the valve seat and the guide bolt extends in the axial direction from a region radially inside the valve seat face on the component.

2. The injector as defined by claim 1, wherein an annular face extending radially outward from the encompassing edge forms an angle with the valve seat face.

3. The injector as defined by claim 2, wherein the angle is between approximately 0.5° and 20°.

4. The injector as defined by claim 1, wherein on the valve sleeve, a pressure engagement face for fuel pressure is provided in an opening direction of the valve sleeve.

5. The injector as defined by claim 2, wherein on the valve sleeve, a pressure engagement face for fuel pressure is provided in an opening direction of the valve sleeve.

6. The injector as defined by claim 3, wherein on the valve sleeve, a pressure engagement face for fuel pressure is provided in an opening direction of the valve sleeve.

7. The injector as defined by claim 4, wherein the pressure engagement face is embodied as a radially extending encompassing pressure step.

8. The injector as defined by claim 5, wherein the pressure engagement face is embodied as a radially extending encompassing pressure step.

9. The injector as defined by claim 6, wherein the pressure engagement face is embodied as a radially extending encompassing pressure step.

10. The injector as defined by claim 4, wherein the pressure engagement face is dimensioned such that at fuel pressures over 2100 bar, in particular over 2200 bar, the valve sleeve lifts from the valve seat.

11. The injector as defined by claim 7, wherein the pressure engagement face is dimensioned such that at fuel pressures over 2100 bar, in particular over 2200 bar, the valve sleeve lifts from the valve seat.

12. The injector as defined by claim 2, wherein the encompassing edge is disposed with radial spacing from an inner surface, guided on the guide bolt, of the valve sleeve.

13. The injector as defined by claim 3, wherein the encompassing edge is disposed with radial spacing from an inner surface, guided on the guide bolt, of the valve sleeve.

14. The injector as defined by claim 4, wherein the encompassing edge is disposed with radial spacing from an inner surface, guided on the guide bolt, of the valve sleeve.

15. The injector as defined by claim 7, wherein the encompassing edge is disposed with radial spacing from an inner surface, guided on the guide bolt, of the valve sleeve.

16. The injector as defined by claim 1, wherein the valve sleeve is embodied integrally with an armature plate of an actuator embodied as an electromagnetic drive, which actuator moves the valve sleeve.

17. The injector as defined by claim 1, wherein the fuel outflow path extends axially into the guide bolt and radially out of the guide bolt into an annular chamber, the annular chamber being defined by the valve sleeve when the control valve is closed.

18. The injector as defined by claim 3, wherein the angle is between approximately 1° and 10°.

19. The injector as defined by claim 18, wherein the angle is approximately 5°.

* * * * *

UNITED STATES PATENT AND TRADEMARK OFFICE

CERTIFICATE OF CORRECTION

PATENT NO. : 8,573,186 B2
APPLICATION NO. : 12/446069
DATED : November 5, 2013
INVENTOR(S) : Rettich et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1232 days.

Signed and Sealed this
Twenty-second Day of September, 2015

Michelle K. Lee

Michelle K. Lee
*Director of the United States Patent and Trademark Office*